United States Patent [19]

Smith

[11] 4,392,795

[45] Jul. 12, 1983

[54] WEAR RESISTANT ROTOR SLOTS FOR VANE-TYPE PUMPS OR MOTORS

[75] Inventor: Larry C. Smith, New Berlin, Wis.

[73] Assignee: Rexnord Inc., Milwaukee, Wis.

[21] Appl. No.: 229,954

[22] Filed: Jan. 30, 1981

[51] Int. Cl.[3] ..... F01C 21/00

[52] U.S. Cl. ..... 418/31; 418/259; 418/268

[58] Field of Search ..... 418/268, 267, 259, 31

[56] References Cited

U.S. PATENT DOCUMENTS

| | | | |
|---|---|---|---|
| 2,612,114 | 9/1952 | Ernst | 418/268 |
| 3,000,324 | 9/1961 | Rosaen | 418/268 |
| 3,255,704 | 6/1966 | Mazur | 418/268 |
| 3,869,231 | 3/1975 | Adams | 418/268 |
| 3,981,647 | 9/1976 | Schoeps | 418/259 |
| 3,981,648 | 9/1976 | Jordan et al. | 418/267 |

FOREIGN PATENT DOCUMENTS

| | | | |
|---|---|---|---|
| 207742 | 2/1968 | U.S.S.R. | 418/267 |

*Primary Examiner*—Charles J. Myhre
*Assistant Examiner*—Andrew M. Dolinar
*Attorney, Agent, or Firm*—John M. Neary; Aaron L. Hardt

[57] ABSTRACT

A rotor, for a vane-type fluid pump or motor, having upper and lower vane contact edges formed in each slot thereof is disclosed. The upper and lower vane contact edges substantially eliminate wear of the slots by the vanes reciprocating therein, thereby enabling pumps or motors employing the rotor to operate with low viscosity liquids for commercially useful periods of time.

15 Claims, 8 Drawing Figures

WEAR RESISTANT ROTOR SLOTS FOR VANE-TYPE PUMPS OR MOTORS

BACKGROUND OF THE INVENTION

This invention relates to fluid translating devices and, more particularly, to rotary, vane-type pumps or motors having an improved rotor.

Rotary, vane-type pumps and motors have been employed as fluid translating devices for many years. U.S. Pat. No. 2,600,633 granted June 17, 1952 to H. French discloses a constant volume, rotary, vane-type pump, while U.S. Pat. No. 3,523,746 granted Aug. 11, 1970 discloses a variable volume, rotary, vane-type pump. Those patents are illustrative of the rotary, vane-type pumps and motors previously employed and the improved rotor of this invention is useful in the constant and variable volume devices they illustrate.

As shown in FIG. 2 of the drawing of this specification, prior art rotors 1 for rotary, vane-type pumps and motors have slots 3 therein that are substantially straight along the entire length of their side walls. The bottom of the slot may be planar, arcuate, as shown in FIG. 2, or bulbous, as disclosed in U.S. Pat. No. 2,711,698 granted June 28, 1955 to L. Bozek, et al. Each slot receives a complementary vane 5 which during the operation of the pump or motor is subjected to forces that cause it to reciprocate in the slot. While the vane is totally positioned inside the slot, its axis is substantially along the axis of the slot. However, as the outward end of the vane increasingly emerges from the slot, the vane tilts in the direction opposite the rotation of the rotor, so that it is positioned with its axis oblique to the axis of the slot and has a bottom edge in contact with a side wall of the slot.

Because the vane is made of a harder material than the rotor, continued reciprocation of the vane against the slot can wear groove 7 in the side wall of the slot intermediate its ends, as shown in FIG. 2, especially if the fluid used in the pump or motor has a low viscosity. Formation of the groove then allows the vane to tilt or tip even more obliquely to the axis of the slot as it reciprocates, thereby wearing a deeper groove which allows further tilting; ad infinitum. Initially, as the groove begins to wear in the slot, the pump or motor will become noisier and produce less fluid flow or pressure. Ultimately, the groove will allow the vane to tilt so obliquely to the axis of the slot that the vane will become wedged in the slot in a manner that prevents it from reciprocating therein and the vane will be broken by the forces exerted on it as the rotor continues to rotate in the pump or motor. Such a broken vane will then cause further damage to other portions of the pump or motor as the rotor continues to rotate.

Accordingly, it will be apparent that a wear resistant rotor slot would be advantageous and desirable, especially for rotors to be employed in pumps or motors translating low viscosity liquids.

SUMMARY OF THE INVENTION

Therefore, it is the primary object of this invention to provide a rotor for a rotary, vane-type fluid pump or motor that has slots therein which obviate the wear caused to slots of previously employed rotors by the reciprocation of a vane therein. Another object is to provide such a rotor which will be especially useful when employed in pumps or motors translating low viscosity liquids.

In accordance with these and other objects, there is provided by the present invention a rotor, for a vane-type fluid pump or motor, having upper and lower vane contact edges formed in each slot thereof. The upper vane contact edge is formed by an intersection of the slot and the circumference of the rotor, while the lower contact edge is formed within each slot on a side wall thereof by a substantially planar undercut formed in the side wall. Significantly, the length of the undercut portion of the slot must be greater than the length of the slot above the undercut portion.

Thus, the planar surface and requisite length of the undercut portion of the slot of this invention is totally distinct in design and function from the bulbous undercut portion of the slot disclosed in the aforementioned Bozek, et al., patent. That undercut slot is used solely to provide output fluid of the pump to the bottom of the vanes to assist them in reciprocating in the slot.

BRIEF DESCRIPTION OF THE DRAWING

Other objects and attendant advantages will be obvious to those skilled in the art by reading the following detailed description in connection with the accompanying drawing wherein like reference characters designate like or corresponding parts throughout the several figures thereof and wherein.

DETAILED DESCRIPTION OF THE INVENTION

Figure 1:
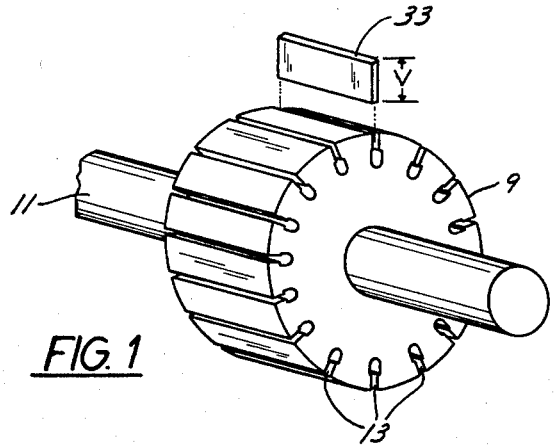
FIG. 1 is a perspective view of a preferred embodiment of the improved rotor contemplated by this invention and having an integral shaft attached thereto.
Figure 6:
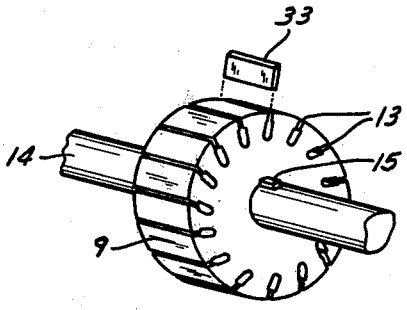
FIG. 6 is a perspective view of another embodiment of the improved rotor contemplated by this invention and keyed to a shaft.

Referring to the drawing, there is shown in FIG. 1, a preferred embodiment of the improved rotor 9 contemplated by this invention. Rotor 9 can be a toroid having an integrally attached shaft 11 and a plurality of slots 13, or alternatively as illustrated in FIG. 6, rotor 9 can be a toroid keyed to a shaft 14 by a key 15. Rotor 9 is, preferably, made of carburized steel.

Figure 3:
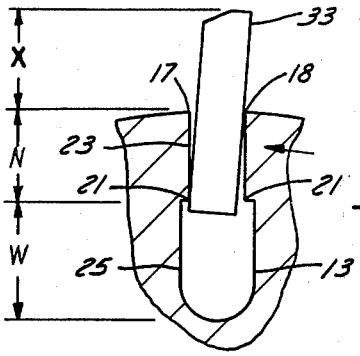
FIG. 3 is an elevational view of a portion of an embodiment of the improved rotor contemplated by this invention and a vane located in a slot thereof.
Figure 4:
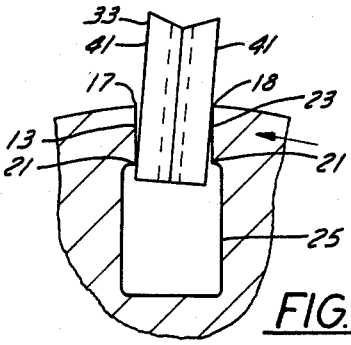
FIG. 4 is an elevational view of a portion of another embodiment of the improved rotor contemplated by this invention, and a preferred vane located in a slot thereof.
Figure 7:
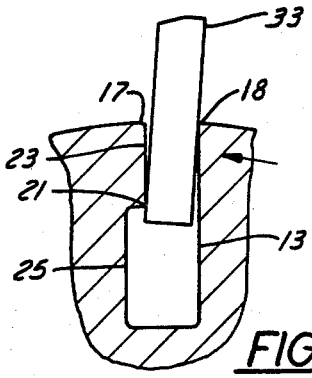
FIG. 7 is an elevational view of a portion of still another embodiment of the improved rotor contemplated by this invention and a vane located in a slot thereof.

The plurality of slots 13 are transverse to the circumference of rotor 9. Slots 13 can be radial, as shown in FIG. 1, or nonradial, as shown in FIG. 6. Slots 13 extend across the entire width of rotor 9 and through its circumference to form a pair of upper contact edges 17, 18 at the intersection of each slot 13 and the circumference, as shown in FIGS. 3, 4 and 7. A lower contact edge 21 is formed within each slot 13 on a side wall thereof by a substantially planar undercut formed in the side wall and dividing the sidewall into an upper portion 23 and a lower or undercut portion 25. Undercut portion 25 must be planar to avoid unnecessarily weakening rotor 9. The depth W of undercut portion 25 must be greater than the depth N of the upper portion 23 of each slot 13. As shown in FIGS. 3 and 4, the rotors 9 of both side walls of slot 13 have been undercut, however, only one side wall of slot 13 may be undercut, as shown in rotor 9 of FIG. 7. As shown in FIGS. 3 and 4, the bottoms of slots 13 may be either arcuate or planar.

Figure 8:
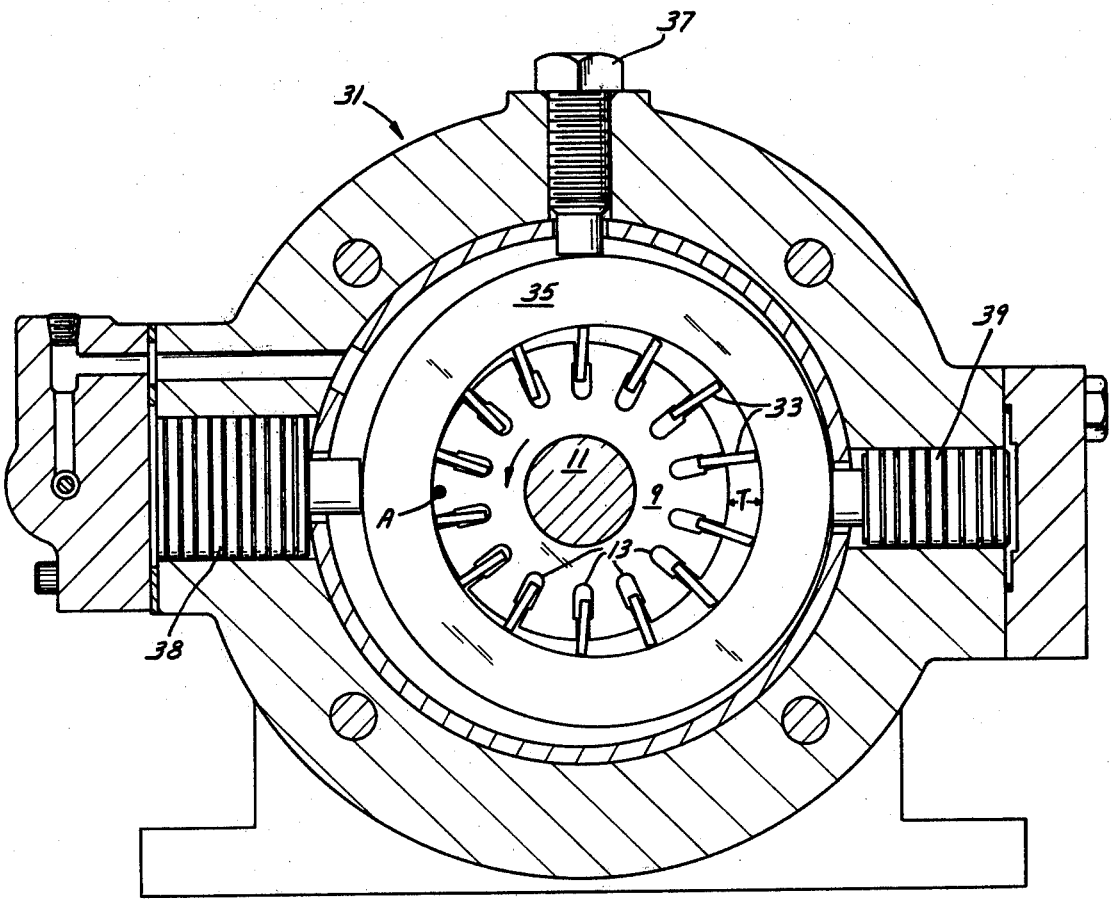
FIG. 8 is a cross-sectional view of a typical variable volume, rotary, vane-type pump or motor employing the improved rotor contemplated by this invention.

When rotor 9 is employed in either a constant or variable volume, rotary, vane-type pump or motor exemplified by the variable volume pump or motor 31 of FIG. 8, rotor 9 will be mounted on shaft 11 on suitable bearings therefor (not shown) within pump or motor 31. Each slot 13 will be in receipt of a complementary vane 33 having a total depth V and a maximum extension X beyond the circumferential surface of the rotor 9. Rotor 9 and vanes 33 will be encircled by a movable cam ring 35 positioned by a conventionally known thrust block 37, bias piston 38 and control piston 39. Vanes 33, preferably, can be made of hardened tool steel.

As rotor 9 rotates in the direction of the arrow thereon in FIG. 8, vanes 33 will reciprocate in their respective slots 13 in response to pressures exerted on vanes 33 by the rotation of rotor 9, movable cam ring 35 and fluid pressures in slots 13. As readily understood by reference to FIG. 8, when point A on the circumference of rotor 9 is in juxtaposition with cam ring 35, a vane 33 carried by a surrounding portion of rotor 9 will be totally within its respective slot 13.

Likewise, because cam ring 35 is eccentric to rotor 9, as rotor 9 rotates, point A first gradually moves away from ring 35, then gradually moves back into juxtaposition with ring 35. This change in the spatial relationship of point A to ring 35 allows vane 33 to first gradually emerge outwardly from its slot 13 and then gradually recede back into the slot. The total range of travel of the vane between its maximum positions of extension and retraction at the position of maximum displacement of the pump is equal to T. To insure that the bottom of vane 33 does not rise above lower contact edge 21 in slot 13, planar undercut portion 25 must have a length greater than the length of upper portion 23 or, to express it more generally, the bottom of the vane will not rise above the lower edge 21 provided that W is greater than T and V is greater than X plus N.

Figure 2:
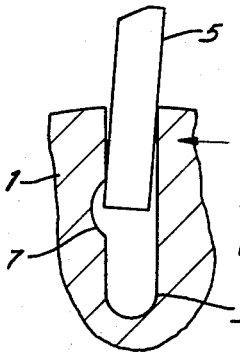
FIG. 2 PRIOR ART
FIG. 2 is an elevational view of a portion of a typical prior art rotor and vane illustrating the wear typically experienced in a slot thereof.

As vane 33 emerges from within its respective slot 13, it is tilted or tipped in the direction away from the direction rotor 9 is rotating, by the force exerted on vane 33 by the fluid within pump or motor 31. As a result, except for those portions of the rotation of rotor 9 when vane 33 is totally within its respective slot 13, vane 33 will reciprocate in slot 13 with its axis oblique to the axis of its slot 13. Then, as shown in FIGS. 3, 4 and 7, vane 33 is in sliding contact with upper contact edge 18 and a lower contact edge of slot 13. Because vane 33 can be made of a harder material than rotor 9, the continued contact of upper contact edge 18 and lower contact edge 21 on vane 33 will not result in significant wear on vane 33. Likewise, the side of vane 33 will not significantly wear the contact edges of slot 13, in contrast to the continued contact of the edge of vane 5 with the side wall of slot 3 in the prior art rotor 1 of FIG. 2.

The rotors of FIGS. 3 and 4, preferably, have both side walls undercut, which makes them wear resistant when rotor 9 is rotated in either a clockwise or a counterclockwise direction. The rotor of FIG. 7, however, will only avoid wear to slot 13 when it is rotated in a counterclockwise direction.

Figure 5:
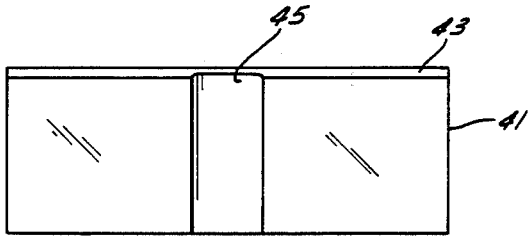
FIG. 5 is a front elevational view of one half of the preferred vane shown in FIG. 4.

FIG. 4 shows a preferred embodiment of vane 33 which consists of a pair of juxtaposed substantially rectangular solids 41. As shown in FIG. 5, each rectangular solid 41 has an inclined tip 43 at its respective upper end and a vertical groove or channel 45 across its entire height. The rectangular solids 41 are juxtaposed face to face so that their respective channels 45 are aligned opposite each other and their respective tips 43 are at opposite upper ends of vane 33. While in use, fluid within the pump or motor employing the vane of FIG. 4 can readily flow through the passage formed by channels 45 to equalize the fluid pressures above and below vane 33. This preferred embodiment of vane 33 has been found to be particularly useful in rotary, vane-type pumps translating low viscosity fluids and, therefore, is particularly advantageous when used in conjunction with the improved rotor of this invention in such pumps or motors while they are translating liquids having approximately 1 centistoke viscosity.

Having described the invention in specific detail and exemplified the manner in which it may be carried into practice, it will now be readily apparent to those skilled in the art that innumerable variations, applications, modifications and extensions of the basic principles involved may be made without departing from its sphere or scope.

I claim:

1. In a rotor for a vane-type fluid pump or motor, said rotor comprising a toroid having a plurality of planar slots transverse to the circumference thereof; each said slot extending across the entire width of said rotor and through said circumference to form a pair of upper edges at the intersection of said slot and said circumference, said slot being for the receipt of a vane complementary to said slot, said vane having side surfaces and a lower edge and a total depth V in said transverse direction, and being disposed for reciprocation in a direction slightly oblique to said transverse direction in said slot between a retracted position and an extended position, said vane in operation having a range of travel T between the maximum positions of retraction and extension in said transverse direction, and a maximum extension of X beyond said rotor circumference, and having a side in sliding contact with one of said upper edges; the improvement to said rotor which comprises:

a side wall configuration in said slots including an upper portion having a width slightly greater than the width of said vane and opening into said circumference, and also including an undercut portion having a width greater than the width of said slot upper portion;

a lower edge formed within each said slot on a side wall thereof at the junction of said undercut portion and said upper portion of said slot;

said upper portion of said slot having a depth N in said transverse direction, and said undercut portion having a depth W in said transverse direction;

wherein W is greater than T, and V is greater than X plus N;

the width of said undercut portion relative to the width of said upper portion being such that sliding contact between each said slot and its respective obliquely reciprocating vane occurs substantially only on a said one upper edge and said lower edge of said slot and the side surfaces of said vane, while contact between said lower edge of said vane and the sides of said slot is substantially prevented.

2. The rotor defined in claim 1, wherein said rotor has a said lower edge formed in each side wall of each slot.

3. The rotor defined in claim 1 or 2, wherein the bottom of said slot is arcuate.

4. The rotor defined in claim 1 or 2, wherein the bottom of said slot is planar.

5. The rotor defined in claim 1 or 2, wherein said plurality of planar slots are radially situated about said toroid.

6. The rotor defined in claim 1 or 2, wherein said toroid is generated by a substantially rectangular closed curve rotated about an axis in its plane that does not intersect it.

7. The rotor as defined in claim 1 or 2, wherein said toroid is integrally attached to a shaft having an axis coincident with the axis of said toroid.

8. The rotor as defined in claim 1 or 2, wherein said toroid is keyed to a shaft having an axis coincident with the axis of said toroid.

9. The rotor as defined in claim 1 or 2 in combination with a said complementary vane freely disposed within each said slot so that it is reciprocable therein.

10. The combination of claim 9, wherein said vane in each said slot is substantially a rectangular solid inclined at its upper end to form a tip thereon.

11. The combination of claim 9, wherein said vane in each said slot comprises a pair of juxtaposed substantially rectangular solids oppositely inclined at their respective upper ends to form a pair of tips at the opposite upper ends of said vane.

12. The combination of claim 11, wherein each said juxtaposed rectangular solid has an aligned channel extending from the upper end to the bottom end thereof along the juxtaposed sides thereof.

13. The rotor as defined in claim 1 or 2 rotatably mounted within a housing for said vane-type fluid pump or motor in combination with a said complementary vane freely disposed within each said slot so that it is reciprocable therein and a cam ring eccentrically surrounding said rotor when said pump or motor is in use, said ring limiting the outwardly travel of each said reciprocable vane, so that the inner end of each said vane never rises outwardly of its respective said lower contact edge of each said slot.

14. The combination of claim 13, wherein the eccentricity of said rotor and cam ring is fixed.

15. The combination of claim 13, wherein the eccentricity of said rotor and cam ring is variable.

* * * * *